US005353525A

United States Patent [19]

Grim

[11] Patent Number: 5,353,525

[45] Date of Patent: * Oct. 11, 1994

[54] VARIABLE SUPPORT SHOE

[75] Inventor: Tracy E. Grim, Broken Arrow, Okla.

[73] Assignee: Vistek, Inc., Calabassas, Calif.

[ * ] Notice: The portion of the term of this patent subsequent to Mar. 19, 2008 has been disclaimed.

[21] Appl. No.: 650,765

[22] Filed: Feb. 4, 1991

Related U.S. Application Data

[63] Continuation-in-part of Ser. No. 310,836, Feb. 14, 1989, Pat. No. 4,999,932.

[51] Int. Cl.[5] ..... A43B 7/06; A43B 7/14

[52] U.S. Cl. ..... 36/88; 36/114; 36/29; 36/3 B; 36/71

[58] Field of Search ..... 36/3 R, 3 A, 3 B, 29, 36/71, 88, 89, 93, 119, 114, 86; 128/594

[56] References Cited

U.S. PATENT DOCUMENTS

| | | | |
|---|---|---|---|
| 311,046 | 1/1885 | Trask | 36/3 B |
| 2,552,711 | 5/1951 | Dunker . | |
| 2,560,591 | 7/1951 | Oltrogge . | |
| 2,676,422 | 4/1954 | Crawford . | |
| 2,774,152 | 12/1956 | Alber | 36/71 |
| 3,029,530 | 4/1962 | Eaton . | |
| 3,331,146 | 7/1967 | Karras . | |
| 3,716,930 | 2/1973 | Brahm | 36/3 B |
| 3,973,336 | 8/1976 | Ahn | 36/3 B |
| 4,236,725 | 12/1980 | Bataille | 36/93 |
| 4,361,969 | 12/1982 | Vermonet | 36/88 |
| 4,414,760 | 11/1983 | Faiella . | |
| 4,702,022 | 10/1987 | Porcher | 36/93 |
| 4,730,402 | 3/1988 | Walkhoff . | |
| 4,763,426 | 8/1988 | Polus . | |
| 4,991,317 | 2/1991 | Lakic | 36/29 |
| 4,995,173 | 2/1991 | Spier | 36/114 |
| 4,999,932 | 3/1991 | Grim | 36/114 |

FOREIGN PATENT DOCUMENTS

| | | | |
|---|---|---|---|
| 0152401 | 8/1985 | European Pat. Off. | 36/93 |
| 2321817 | 11/1973 | Fed. Rep. of Germany . | |
| 2845824 | 5/1979 | Fed. Rep. of Germany | 36/93 |
| 538325 | 1/1956 | Italy | 36/3 B |

*Primary Examiner*—Steven N. Meyers
*Attorney, Agent, or Firm*—Poms, Smith, Lande & Rose

[57] ABSTRACT

An athletic shoe includes a substantially flat pump chamber in the sole of the shoe under the heel of the user, with a one-way valve permitting the drawing in of air when pressure is taken of the heel, and second one-way valve at the outlet from the flat pump which comes into play as air is being exhausted from the chamber. One or more pressure bladders for receiving air from the pump mentioned above, are mounted in the sidewalls of the shoe, toward the rear thereof adjacent the ankle. When the user is active, and is walking or running, the pump is automatically actuated to inflate the air bladders and to provide additional support for the foot and the ankle. The air bladders may be provided with a relief valve to prevent overpressure, and/or with arrangements for slowly leaking air out of the bladder so that when the user is resting, pressure on the foot and ankle is minimized. This last function may be accomplished, either by a bleed valve, or by a series of fine perforations in the walls of the bladder.

19 Claims, 4 Drawing Sheets

VARIABLE SUPPORT SHOE

RELATED APPLICATIONS

This application is a continuation-in-part application based upon applicant's pending application Ser. No. 07/310,836, filed Feb. 14, 1989, now U.S. Pat. No. 4,999,932, granted Mar. 19, 1991.

FIELD OF THE INVENTION

This invention relates to athletic shoes, providing additional support for the user.

BACKGROUND OF THE INVENTION

It has previously been proposed to provide an ankle brace, or orthopaedic apparatus including air inflatable bladders as shown in U.S. Pat. No. 4,280,489, in which the apparatus is intended to be worn within a separate shoe, and is inflatable with an external source of air pressure. In addition, various arrangements have been proposed for ventilating shoes by circulating air through the shoes. Typical patents showing this type of arrangement include M. Dunker U.S. Pat. No. 2,552,711; D. W. Oltrogge, U.S. Pat. No. 2,560,591; A. C. Crawford, U.S. Pat. No. 2,676,422; C. N. Eaton, U.S. Pat. No. 3,029,540; E. Karras, U.S. Pat. No. 3,331,146; and James Faiella, U.S. Pat. No. 4,414,760. These patents disclose the use of air pumping arrangements actuated by foot pressure for circulating air through a shoe, but do not include any orthopaedic support functions.

Additional prior art patents are noted as follows: First, the Gertsch German Patent No. 2,321,817, discloses a bellows pump system designed for ski boots. It is suggested that the pump be mounted in a recess in the bottom of the thick sole of the ski boot. To inflate or deflate the air chambers, a manually operated three-way valve is employed. One end plate of the bellows swings outward from the sole of the boot. To hold the bellows pump flush to the sole of the ski boot when not in use, a retaining hook is used in the Gertsch arrangements. Walkhoff, U.S. Pat. No. 4,703,403, discloses a pump system for a sports shoe, such as a ski boot. Walkhoff discloses that a pump system is recessed in the sole of his shoe and is activated by placing the pump on an "elevation" on the ski and activating the pump by a rocking motion of the foot. The Walkhoff drawing shows the activation side of the pump facing down for activation by engagement with the "elevation" on the ski. In the cases of both the Gertsch and Walkhoff devices, the pump is exposed through the sole of the shoe and if an attempt were made to walk or run with the shoes, mud, debris, or sharp objects may penetrate and/or clog the pumps and render them inoperative. Polus, et al., U.S. Pat. No. 4,763,426, discloses a sport shoe sole which has a number of cylindrical air chambers in the sole to improve the resiliency of the shoe. This patent discloses a pneumatic inflating device to inflate said cylindrical air chambers. This patent does not, however, offer any means for supporting the upper portion of the wearer's foot or ankle. The Polus specification mentions continuous "slight unloading" of the air chambers, indicating that leakage of the air chambers is undesired, and it appears that such leakage may be the reason that a pump is required in this Polus device. Moreover, it is clear that there is no indication whatsoever that such reduction in pressure over time is desirable, but only that it appears to be undesirable as constituting "unloading" of the air chambers.

In connection with athletic activities, such as football, basketball, tennis, or other vigorous activities, it is helpful if the footwear worn by the players gives full support to the foot and ankle to avoid sprains or subluxation, when vigorous movement is undertaken by the athlete. However, when the athletes are resting, on the bench, for example, it is undesirable to have the feet or ankles subject to substantial pressure, as this may inhibit circulation or the like during these rest periods.

Accordingly, a principal object of the present invention is to provide an athletic shoe which gives variable support to the foot and ankle, with increased support during periods when the user is active, and reduced or minimal support when the user is at rest. Another object of the invention is to provide an orthopedic shoe in which external air pumping arrangements are not required.

SUMMARY OF THE INVENTION

In accordance with the present invention, an athletic shoe is provided with an air pump included in the sole, preferably under the heel of the shoe, and air support bladders are mounted in the sides of the shoe and adjacent the upper rear portion of the shoe in the vicinity of the ankle, with the air bladders being connected to receive air pressure provided by the pump in the sole of the shoe.

These air bladders may have a high pressure release valving arrangement, and also be provided with bleed arrangements, so that the bladders may not be inflated above a predetermined pressure, and so that the air pressure in the bladders will gradually leak out over a period of time.

One-way valves may be provided, both at the inlet to the pump, and at the outlet therefrom, leading to the air bladders. In this way, pressure will be drawn in whenever the foot is raised, and air will be pumped out to the air bladders whenever the foot engages the ground, and the pump chamber is compressed. The bladders may have a bleed valve arrangement as mentioned above which may be either in the form of a specific physical valve, or this function may be provided through a series of small holes extending through the surface of the support bladders mounted in the sidewalls of the shoes.

The pump may be in the form of a relatively flat chamber underlying the heel of the user, and being normally resiliently biased so that the air chamber is expanded. Then, when the weight of the person's heel is applied downward onto the chamber, it is compressed, and the air is forced into the support bladders. Subsequently, when the foot is raised, the pump chamber expands, under the resilient force, and air is sucked into the pump chamber. This process is repeated until the support bladders reach their full rated pressure. At this pressure level, the release valve may prevent further build-up of pressure within the bladders, thus controlling the level of pressure against the foot and ankle and the resultant support.

The valves may be implemented by separate valves which may be purchased independently and installed in the interconnecting tubing, or they may be implemented by integral plastic parts in the form of flaps or resiliently mounted plugs which close and open to control the air flow in a manner similar to the separate or independent valves.

At the outlet from the pump, a single one-way valve may be provided, or, alternatively, separate one-way valves may extend to each of the support bladders.

The advantage of the system of the present invention is that full support to the foot is provided when the user is active, but, when the user is resting, or the athlete is on the bench, the bleed arrangements permit the full reduction of pressure in the bladders, so that heavy support pressure is not applied to the foot during rest periods, and full circulation and recuperation of the foot may occur.

Other objects, features, and advantages of the invention will become apparent from a consideration of the following detailed description and from the accompanying drawings.

DETAILED DESCRIPTION

Figure 1:
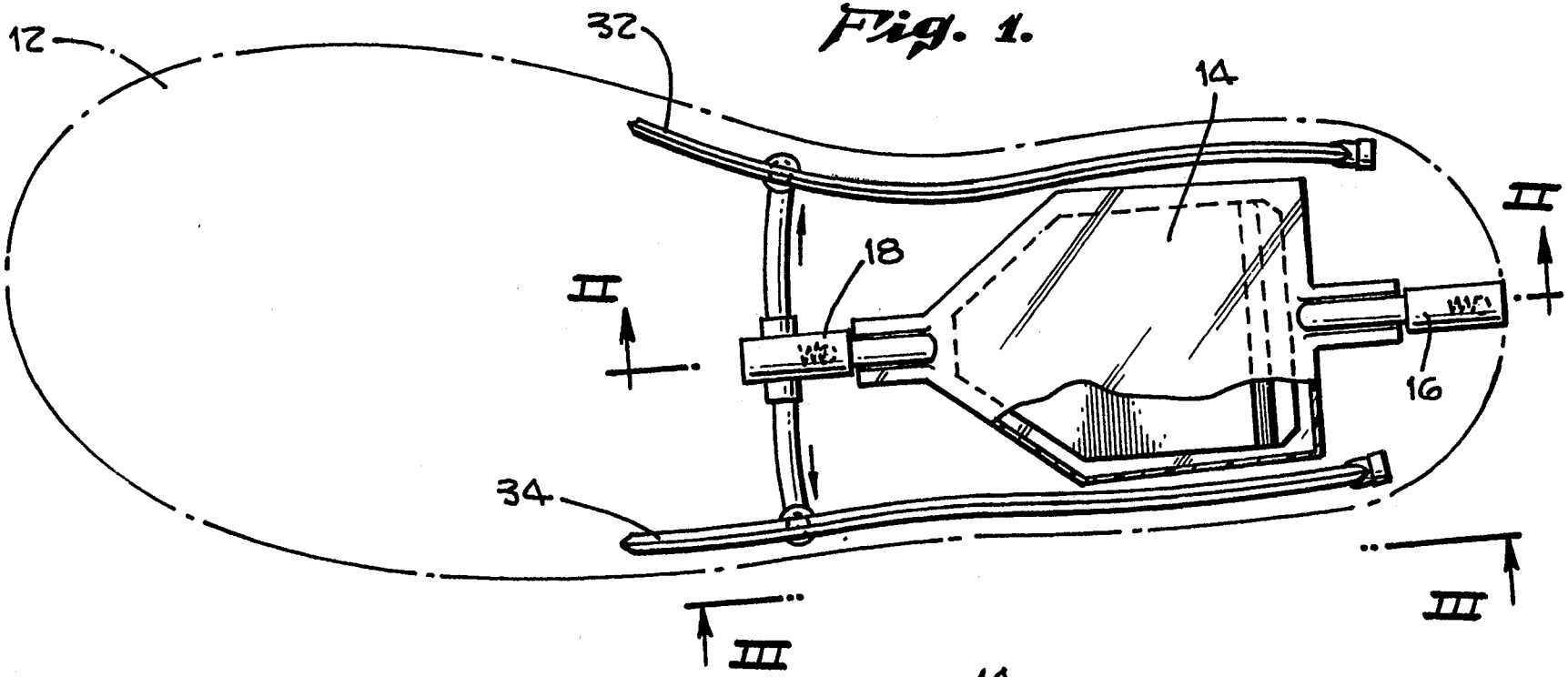
FIG. 1 is a top view of the sole portion of a shoe provided with pumping and support bladders, illustrating the principles of the present invention.
Figure 2:
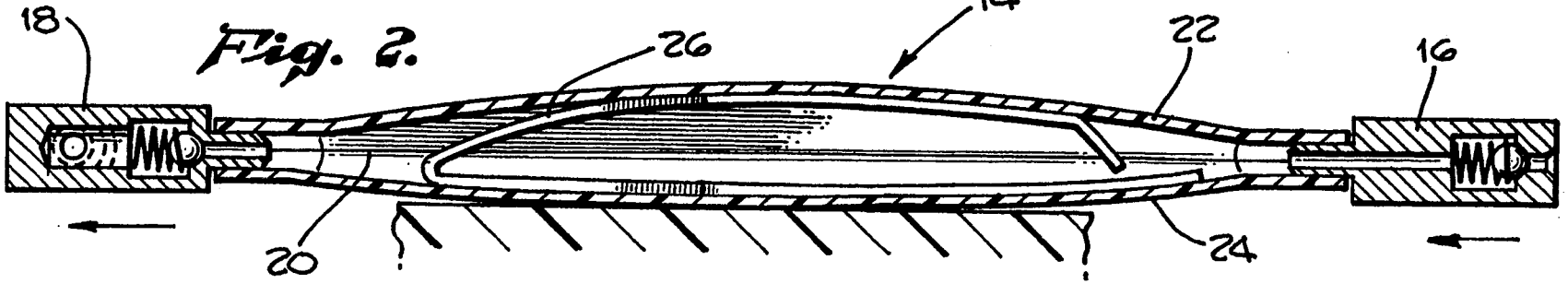
FIG. 2 is a side view of the pump structure taken along plane 2—2 of FIG. 1.

Referring more particularly to the drawings, FIG. 1 is a top view of the sole portion of a shoe 12 as shown in diagrammatic or outline form. Toward the rear of the shoe, under the heel area, is a pump 14 having an inlet valve 16, and an outlet valve 18. As better shown in the cross-sectional view of FIG. 2 of the drawings, the pump 14 includes a chamber 20 having upper and lower flexible sidewalls 22 and 24, and a resilient bent metal spring member 26 which may be formed of brass, or a suitable, flexible spring steel, and which normally biases the chamber 20 to its expanded volume configuration. When the user steps down on the pump 14, the valve 18 opens, and the valve 16 is closed. However, when the foot is raised and pressure is released from the pump 14, the resilient spring member 26 expands the chamber 20, drawing air in through the valve 16, while the valve 18 is closed.

Figure 3:
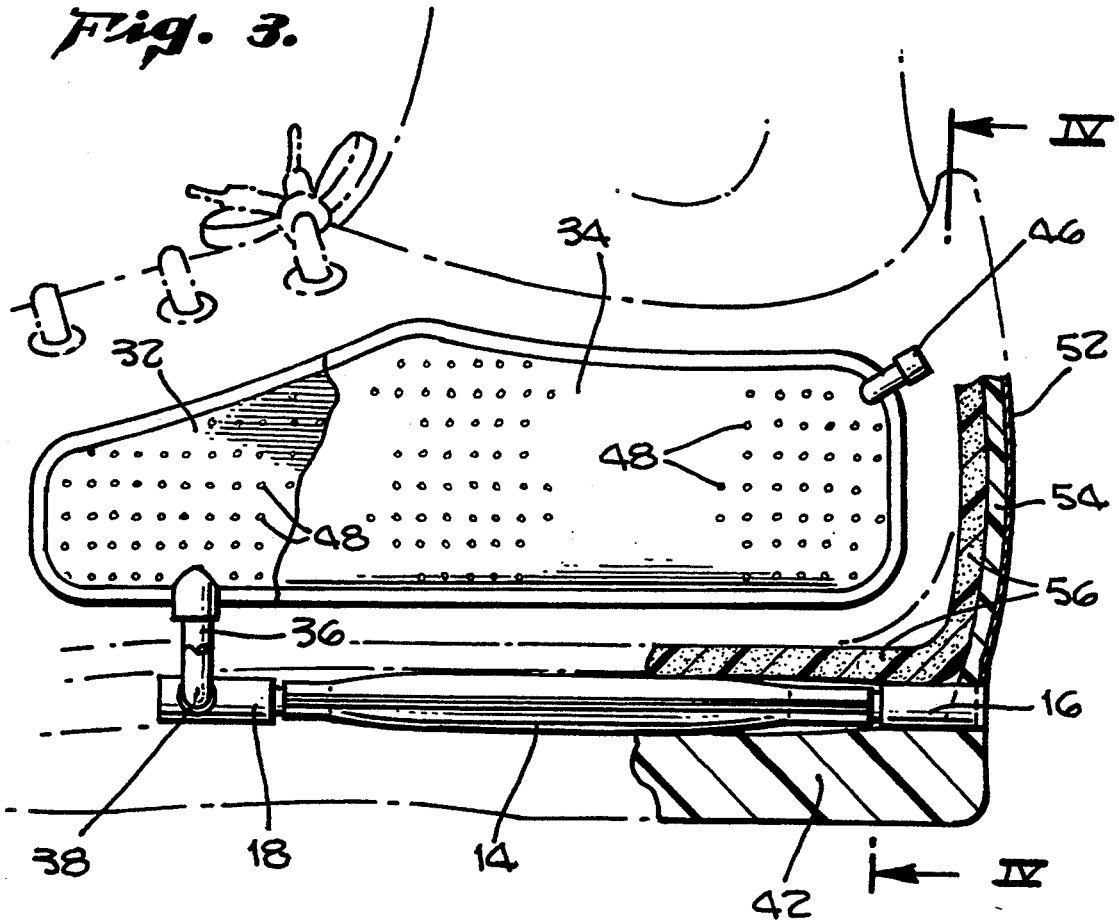
FIG. 3 is a side view of an athletic shoe provided with a pump in the heel portion of the sole of the shoe, and support bladders mounted on the inner sides of the shoe.

Shown to advantage in FIG. 3, as well as in FIG. 1, two support bladders or chambers 32 and 34 may be provided, and these may extend along the sides of the foot, and over the upper surface of the outer portion of the foot, and along the side and the rear portion of the instep of the user. Extending upward from the valve 18 are two small diameter tubes 36 and 38 connected to the bladders 32 and 34, respectively.

Figure 4:
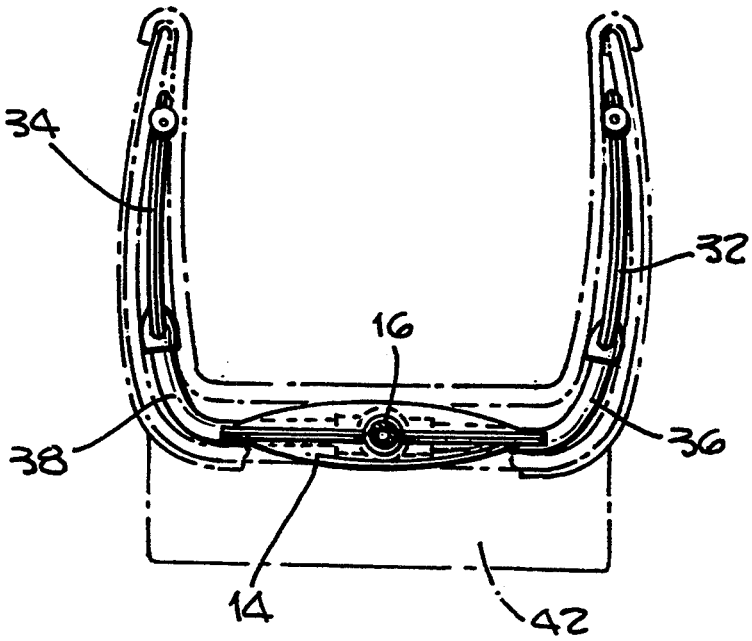
FIG. 4 is a cross-sectional view taken along plane 4—4 of FIG. 3.

Incidentally, FIG. 4 is a cross-sectional view taken along the plane 4—4 of FIG. 3 and showing the sole 42, the pump assembly 14, the inlet valve 16, the two side chambers 32 and 34, and the coupling tubes 36 and 38. The shoe is shown in dash-dot lines, while the pump and the support bladders are shown in solid lines.

Figure 5:
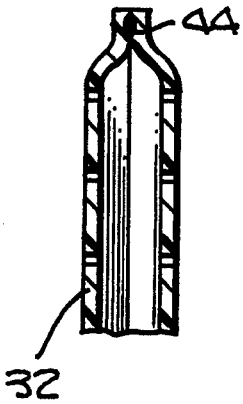
FIG. 5 is a partial cross-sectional view taken along plane 5—5 of FIG. 3.

FIG. 5 shows one of the bladders 32 formed of two portions of sheet plastic, heat-sealed together at point 44.

Returning to FIG. 3, the valve 46 is an overpressure release and a bleed valve. More specifically, a slight amount of air is permitted to bleed from the valve 46 continuously over prolonged periods of time, as will be discussed hereinbelow, and the valve 46 changes state to release air from the bladder when pressure supplied by the pump 14 becomes excessive, so that a maximum pressure level is maintained within the bladders 32 and 34 during active use of the footwear. The relief valve 46 may provide a maximum pressure of between 0.5 psi and about 5 psi, above atmospheric pressure, and may either be adjustable, or preset to the desired relief pressure. As an alternative to the bleed function which may be included in the valve 46, the bladders 32 and 34 may be provided with a number of very small holes 48, which may be in the nature of pin holes, which may provide the bleed function which may otherwise be accomplished through the valve member 46.

Incidentally, the relief valves 46 may be located at any desired position, including adjacent to the entry duct 86, or along the lines from the pump to the bladders.

The shoe may have an outer wall 52 which may be formed of leather or heavy fabric material, a structural lining 54 immediately within the outer wall 52, and an inner resilient liner 56 within the structural walls 52 and 54, and overlying the pump member 14 on the sole of the shoe. The bladders 32 and 34, and the ducts 36 and 38 may be embedded or recessed into the wall 56.

Figure 6:
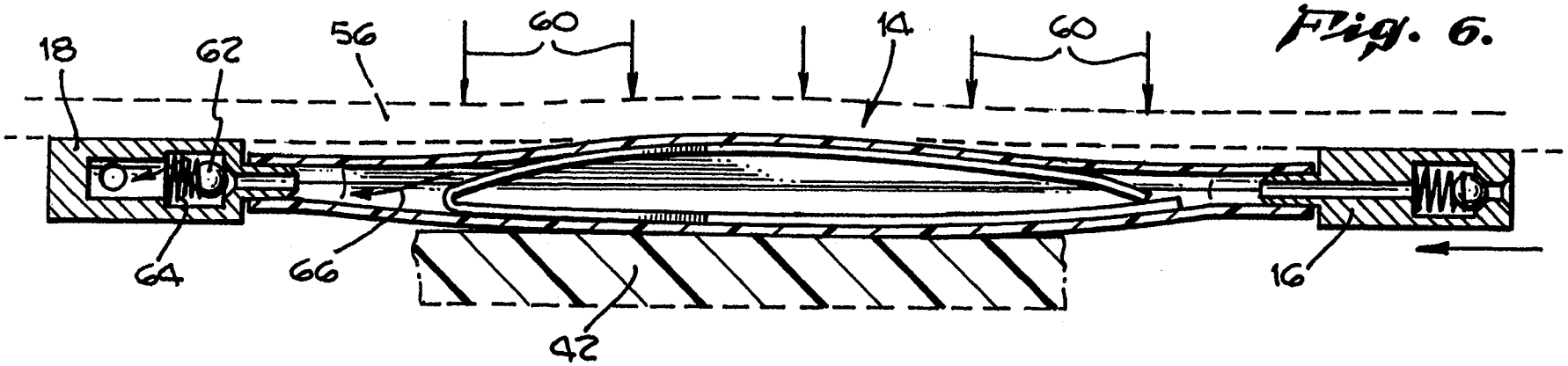
FIG. 6 is a cross-sectional view similar to that of FIG. 2 showing force applied to the pump, and the output one-way valve being released.

Now, referring to FIG. 6, the mode of operation of the pump 14 under operating conditions is illustrated. More specifically, the arrows 60 indicate the force of the foot or heel acting downward to compress the flat chamber configuration of the pump 14. Air has previously been drawn into the pump chamber 20 through the inlet valve 16. Now, when downward pressure indicated by arrows 60 compresses the chamber 20 of pump 14, the on-way valve 18 opens, and air flow through the valve 18 to the two support bladders or chambers 32 and 34. The valve 18 is indicated as including a ball 62, spring-biased by the spring 64 toward its seat, but shown in FIG. 6 in the open configuration, as the chamber 20 is being compressed, and air is flowing toward the valve 18 as indicated by the arrow 66.

Figure 7:
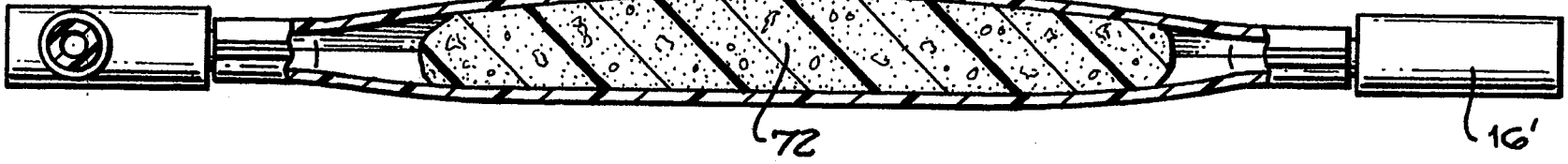
FIG. 7 shows an alternative embodiment of the pump arrangement of FIG. 6.

FIG. 7 shows an alternative embodiment of the pump 14' in which the spring 26, as shown in FIG. 6, has been replaced by the resilient material 72, which may be a relatively stiff, open cell foam material, which serves substantially the same function as the spring 26. The open cell foam material 72 may have channels extending through it to facilitate air flow from the valve 16' to the valve 18'. Otherwise, the pump of FIG. 7 operates in the same manner as that of FIG. 6 as discussed above.

Figure 8:
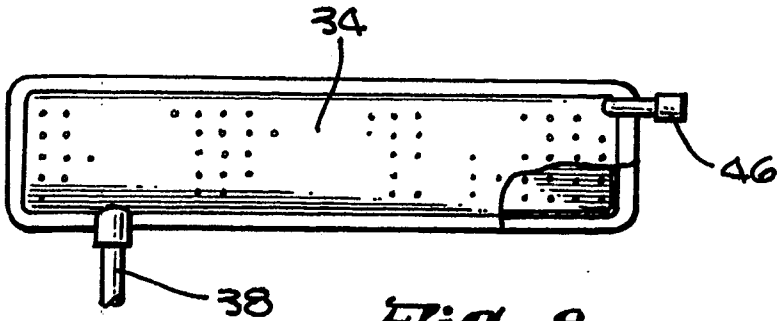
FIG. 8 is a side view of a support bladder which may be employed on the inner sides of the shoe of FIG. 3.

FIG. 8 is a detailed showing of one of the support bladders 34, which has been described in some detail hereinabove in connection with earlier figures of the drawings.

Figure 9:
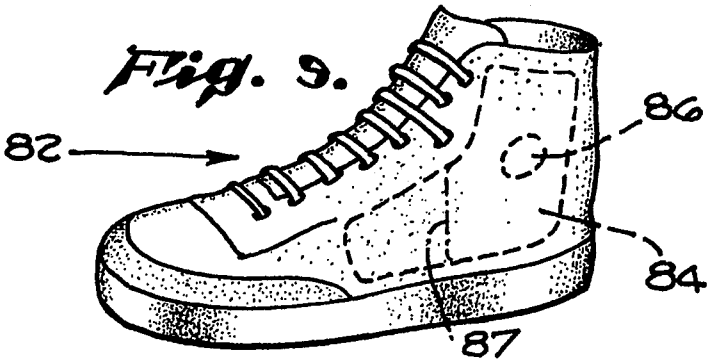
FIG. 9 indicates schematically the principles of the invention as applied to a high top shoe.

FIG. 9 shows an embodiment of the invention as applied to high top shoes of the type which might be employed for basketball, by way of specific example. More particularly, the shoe 82 may be provided with two support bladders, one of which is shown at 84, diagrammatically indicated on the outer side of the shoe. The bladder may have one central area 86 where the opposite walls of the bladder are secured together, so that no inflation occurs. This area 86 is located at the zone where the ankle bone protrudes outwardly from the foot. Alternatively, the bladder may be continuous, without the areas 86, so that the air bladder covers the entire ankle area. The two bladders, one on the inside and one on the outside of the foot may be inflated as described hereinabove for the low quarter shoe of FIG. 3. Also, the forward extent of the bladders could be limited to the line 87 as shown in FIG. 9 when pressure on the forward area of the foot is not desired.

Figure 10:
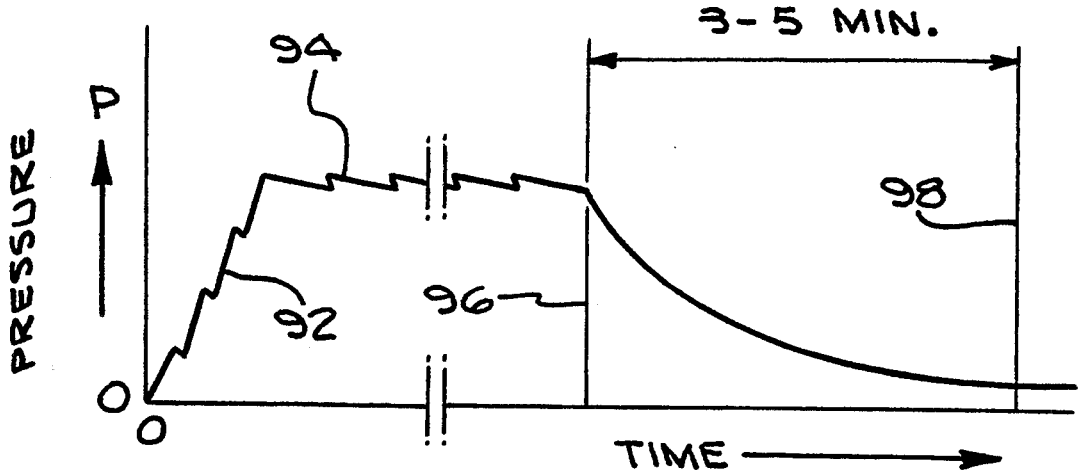
FIG. 10 is a qualitative showing of the pressure within the support chambers during active use by an athlete, and during rest periods.

FIG. 10 is a schematic diagram in which pressure in one of the individual bladders 34 and 36 is plotted against time. Initially, of course, at time equal to zero, the support bladders are not inflated. The steep and initial step portion 92 of the plot indicates the increase in pressure within the bladder in increments, on the occasion of successive steps by the user, and accompanying compression of the pump 14. After several steps, the maximum pressure area 94 is reached, and the relief valve 46 comes into play. Finally, as indicated by the line 96, the user is resting, and not actuating the pump 14. Accordingly, the portion 98 of the pressure characteristic indicates the action of the bleed valve, or the fine pin holes in the support bladders 32 and 34. After about 3 to 5 minutes, the pressure is reduced to a relatively low level, so that full circulation may be present in the foot, with the significant additional pressure from the support bladders having been released.

Figure 11:
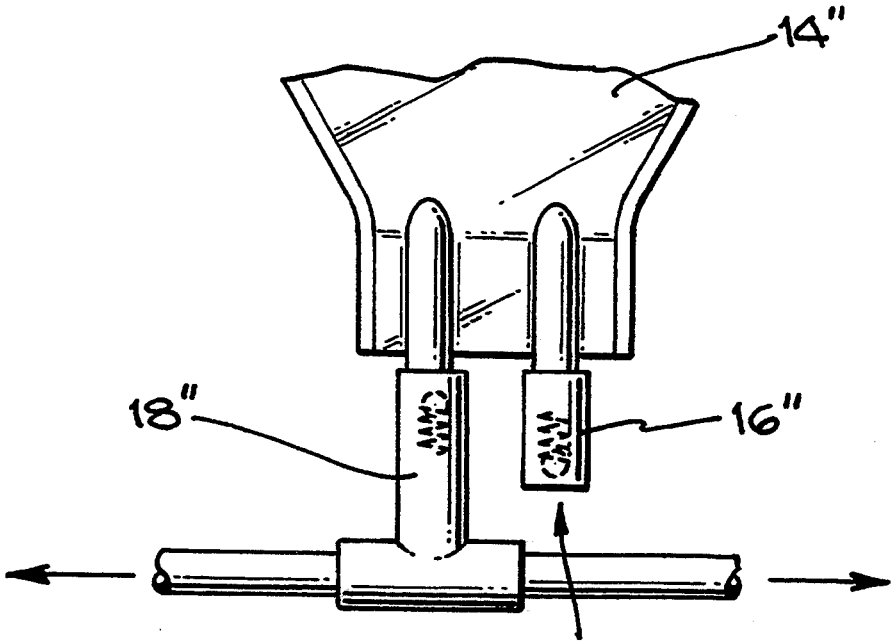
FIG. 11 shows an alternative inlet and outlet configuration for the pump.

FIG. 11 shows another alternative arrangement for the pump 14″ in which the inlet 16″ is taken from within the shoe, and the outlet 18″ is the same as previously shown. Thus, while under certain circumstances and for certain applications, the intake 16 as shown in FIG. 3 would be acceptable under adverse conditions where wet or muddy conditions might prevail, it would be undesirable to draw in moisture, mud, or other foreign material, and accordingly, it would be preferred to draw air in from within the shoe, providing a supplemental ventilating feature by this arrangement.

It is interesting to note that, as the pressure builds up in the support bladders 32 and 34, the valve 18, as shown in FIG. 6, will have additional back pressure on it, and will only open after the pressure level in the pump 14 reaches an elevated level. This will change the resistance encountered by the foot or the heel as the user walks or runs, and there will be less "give" or flexing of the chamber 20, supplementing the increased support provided by the inflated air bladders. It is further noted that, in accordance with the desires of the user, or the orthopedic condition of the user, the pump chamber 20 may be maintained in its more resilient or compressible state by opening the inlet valve 16 when the pressure level in the support bladders exceed a predetermined level. When this configuration is employed, the resilience or flexibility provided by the pump 14 will be increased, and the stiffness decreased. It is further noted that the arrangements as described hereinabove, and particularly the mode of operation as described in connection with FIG. 10 of the drawings is significantly different from the arrangements of the prior art patents as set forth in the Background of the Invention section of the specification.

In conclusion, it is to be understood that the foregoing detailed description relates to one presently preferred embodiment of the invention. Various changes and modifications may be made without departing from the spirit and scope of the invention. Thus, by way of example, and not of limitation, the various valve structures which have been shown as separate elements, may be implemented by constructions formed from the materials out of which the shoe and/or the bladders are made. Thus, plastic flaps may form one-way valve constructions and the pressure release valve may be formed of a plastic, rubber, or other material which is resiliently biased closed, and forced open when a predetermined level of pressure is reached. Further, foam or some other compressible material may be included within the bladders to maintain shape in the deflated state, or between the bladder and the foot. The inflatable bladders may be located within the tongue of the shoe, if desired, in addition or instead of the locations shown in the drawings. It is also to be understood that the configuration of the support bladders may be varied to suit the particular athletic activity of the requirements of the user. It is further noted that a pump or bellows may be located under the arch or forefoot instead of, or in addition to that located under the heel, as shown in the drawings. In addition, one or two elongated strips of sheet plastic material may be employed with the high top shoe embodiment, outside of the bladders, between the bladder and the shoe material, on one or both sides of the ankle, to provide additional support and to keep the bladders from stretching the shoe material. It is also noted that the present invention may be sold for use with existing conventional sport shoes, with an insertable inner sole including the pump, and inflatable bladders which may be mounted on the inner surfaces of the shoe, around the ankle and upper portion of the foot, by permanent pressure-sensitive adhesive, by Velcro, or in any other desired manner. Accordingly, the present invention is not limited to the constructions precisely as shown in the drawings or described in the detailed description.

What is claimed is:

1. In a variable air support shoe for providing .support to an ankle and an upper foot and ankle area of a user, said Support shoe including a sole having a lower surface, sidewalls secured to said sole, and laces for securing the sidewalls of said shoe together, said shoe including a tongue and upper portions of said side walls constituting means for enclosing the upper portion of said shoe and said ankle;

the improvement comprising:

inflatable bladders;

means for mounting said inflatable bladders on said means for enclosing the upper portion of said shoe and said ankle, for applying supporting pressure to the upper foot and ankle area;

pump means mounted in the sole of the shoe;

said sole being substantially continuous on its lower surface in the area where said pump means is located and is free of any recess exposing said pump from below said shoe;

said shoe including means for automatically actuating said pump means by the foot during normal walking or running for supplying air to said bladders; and relief means for selectively releasing air from said bladders;

whereby walking or running activity increases the air pressure in said shoe and provides additional support against possible injury to the foot or ankle.

2. A variable air support shoe for providing support to an ankle and an upper foot and ankle area of a user, said shoe including a tongue and upper portions of said side walls constituting means for enclosing the upper portion of said shoe and said ankle, comprising:

a sole;

sidewalls secured to said sole;

inflatable bladders;

means for mounting said inflatable bladders on said means for enclosing the upper portion of said shoe and said ankle, for applying supporting pressure to the foot on the sides and the rear of the foot;

pump means mounted in the sole of the shoe;

said sole being substantially continuous on its lower surface in the area where said pump means is located and is free of any recess exposing said pump from below said shoe;

said shoe including means for automatically actuating said pump means during normal walking or running for supplying air to said bladders; and one-way valving means for preventing flow of air back from said bladders to said pump means;

whereby walking or running activity increases the air pressure in said shoe and provides additional support against possible injury to the foot or ankle.

3. A shoe as defined in claim 2 wherein said shoe includes one-way inlet valve means for supplying air to said pump means.

4. A shoe as defined in claim 3 wherein means are provided for supplying air to said inlet valve means from within the shoe.

5. A shoe as defined in claim 2 wherein said pump means includes a variable volume air chamber and resilient means for biasing said chamber to its expanded configuration.

6. A shoe as defined in claim 2 wherein said pump means is relatively flat and is mounted in the heel area of the shoe.

7. A shoe as defined in claim 2 wherein said shoe extends up over the ankle of the user, and wherein said bladder means extend around the ankle area of the shoe.

8. A variable air support shoe for providing support to an ankle and an upper foot and ankle area of a user, said support shoe comprising:

a sole;

sidewalls secured to said sole;

said shoe including a tongue and upper portions of said side walls constituting means for enclosing the upper portion of said shoe and said ankle;

inflatable bladder means;

means for mounting said inflatable bladder means on said means for enclosing the upper portion of said shoe and said ankle, for applying supporting pressure to the foot and ankle area on the sides thereof;

pump means mounted in the sole of the shoe automatically actuated by the foot when walking or running for supplying air to said bladder means;

said pump means (a) being encapsulated wholly within the shoe during active pumping action and during use of the shoe, (b) forming a resilient support for the foot, and (c) being mounted above the bottom of the sole; and said shoe including means for automatically actuating said pump means by pressure between the foot and the sole of the shoe during normal walking and running;

whereby walking or running activity increases the air pressure in said shoe and provides additional support against possible injury.

9. A shoe as defined in claim 8 further comprising means for preventing over-inflation of said bladders.

10. A shoe as defined in claim 8 wherein said shoe is formed of flexible material suitable for walking or running and has a sole with a continuous unitary lower surface.

11. A shoe as defined in claim 8 wherein said shoe includes one-way valve means interconnecting said pump and said bladders.

12. A shoe as defined in claim 8 wherein said shoe is a high-top shoe extending up over the ankle of the user, and wherein said bladder means supports the ankle area of the shoe and the user.

13. In a variable air support shoe having a sole, sidewalls secured to said sole, and laces for securing the sidewalls of said shoe together, said shoe including a tongue and upper portions of said side walls constituting means for enclosing the upper portion of said shoe and an ankle, said shoe having an inner area above said sole for receiving the foot of a user;

the improvement comprising:

inflatable bladders;

means for mounting said inflatable bladders on said means for enclosing the upper portion of said shoe and said ankle, for applying supporting pressure to the foot and ankle area toward the sides and the rear thereof;

means including a pump mounted in the sole of the shoe automatically actuated by the foot when walking or running for supplying air to said bladders, and maintaining them at an elevated pressure during such walking or running activity;

relief means for automatically releasing air from said bladders over a predetermined period of time which is relatively long compared to the periodicity of normal walking or running steps;

said shoe being formed of flexible material so as to be suitable for walking or running and having a sole with a continuous lower surface; and said shoe further having flexible material between said pump means and the inner area of the shoe for direct actuation of the pump means by the foot;

whereby walking or running activity increases the air pressure in said shoe and provides additional support against possible injury to the foot or ankle, and the increased pressure is released within a few minutes after the activity stops to minimize pressure on the foot while resting.

14. A variable air support shoe as defined in claim 13 wherein the bottom of the sole of said shoe is continuous in the area where said pump is located and is free of any recess exposing said pump from below said shoe.

15. A variable air support shoe for providing support to an ankle and an upper foot and ankle area of a user, said support shoe comprising:

a sole;

sidewalls secured to said sole;

said shoe having an inner area above said sole for receiving the foot of a user;

inflatable bladder means mounted on said sidewalls for applying supporting pressure to the foot and ankle area on the sides and the rear thereof;

pump means mounted in the sole of the shoe automatically actuated by the foot when walking or running for supplying air to said bladder means;

said pump means (a) being encapsulated wholly within the shoe during active pumping action and during use of the shoe, (b) forming a resilient support for the foot, and (c) being mounted above the bottom of the sole;

said shoe including means for actuating said pump means during normal walking or running by pressure between the foot and the sole of the shoe;

one-way valving means for preventing flow of air back from said bladder means to said pump means;

said shoe being formed of flexible material so as to be suitable for walking or running and having a sole with a continuous unitary lower surface; and said shoe further having flexible material between said pump means and the inner area of the shoe for direct actuation of the pump means by the foot during normal walking or running by the user;

whereby walking or running activity increases the air pressure in said shoe and provides additional support against possible injury.

16. A variable air support shoe as defined in claim 15 wherein the bottom of the sole of said shoe is continuous in the area where said pump is located and is free of any recess exposing said pump from below said shoe.

17. In footwear having a toe end and a heel end and having an outer sole extending from said toe end toward said heel end, said outer sole having an exterior surface for contact with the ground, and said footwear having an upper portion connected to said sole forming an enclosure for enclosing at least a part of the foot of a wearer between the outer sole and the upper portion, and within said enclosure an inner supporting surface for supporting the bottom of a foot, said inner supporting surface extending from the heel end toward said toe end, the improvement therein comprising:

bladder means for holding air, said bladder means being positioned at least partially within said enclosure;

pumping means including a compressible chamber for delivering outside ambient air to said bladder means by flexing between said inner supporting surface and said exterior surface of said footwear, a segment of said hollow space and a portion of said exterior surface and having two ends, one said end being closer to said toe end of said footwear and connected to said main sole portion, said pumping means being subject to deflection by a force applied between said inner supporting surface and said segment exterior surface, whereby said hollow space may be alternatively reduced and returned to its unreduced size, in flexing in response to said force, to deliver said air;

said footwear including means for automatically actuating said pumping means during normal walking and running; and said sole being substantially continuous on its lower surface in the area where said pump means is located and is free of any recess exposing said pump from below said shoe.

18. A variable air support shoe, said shoe including a tongue and upper portions of said side walls constituting means for enclosing the upper portion of said shoe and an ankle, comprising:

a sole;

sidewalls secured to said sole;

inflatable bladders;

means for mounting said inflatable bladders on said means for enclosing the upper portion of said shoe and said ankle, for applying supporting pressure to the foot on the sides and the rear of the foot;

pump means mounted in the sole of the shoe;

said sole being substantially continuous on its lower surface in the area where said pump means is located and is free of any recess exposing said pump from below said shoe;

said shoe including means for automatically actuating said pump means during normal walking or running for supplying air to said bladders;

one-way valving means for preventing flow of air back from said bladders to said pump means; and means for automatically bleeding air from said bladder means to maintain pressure within said bladder means during active pumping, but to permit a reduction in pressure during inactive periods;

whereby walking or running activity increases the air pressure in said shoe and provides additional support against possible injury to the foot or ankle.

19. A shoe as defined in claim 2 wherein said means for bleeding air includes a plurality of tiny holes in said bladder means.

* * * * *